US010647496B2

(12) United States Patent
Alon

(10) Patent No.: US 10,647,496 B2
(45) Date of Patent: May 12, 2020

(54) CONTAINER APPARATUS FOR STORING AND COMBINING MATERIALS

(71) Applicant: Pnina Alon, Be'er Ora (IL)

(72) Inventor: Pnina Alon, Be'er Ora (IL)

( * ) Notice: Subject to any disclaimer, the term of this patent is extended or adjusted under 35 U.S.C. 154(b) by 633 days.

(21) Appl. No.: 15/123,683

(22) PCT Filed: Mar. 3, 2015

(86) PCT No.: PCT/IL2015/050226

§ 371 (c)(1),
(2) Date: Sep. 6, 2016

(87) PCT Pub. No.: WO2015/136519

PCT Pub. Date: Sep. 17, 2015

(65) Prior Publication Data

US 2017/0073144 A1 Mar. 16, 2017

Related U.S. Application Data

(60) Provisional application No. 61/952,161, filed on Mar. 13, 2014.

(51) Int. Cl.
*B65D 81/32* (2006.01)
*B65D 25/08* (2006.01)
(Continued)

(52) U.S. Cl.
CPC ..... *B65D 81/3222* (2013.01); *B65D 25/08* (2013.01); *B65D 43/0212* (2013.01); *B65D 51/2864* (2013.01); *B65D 81/3216* (2013.01); *B65D 81/3818* (2013.01); *A47G 2400/062* (2013.01); *B65D 2543/00083* (2013.01); *B65D 2543/00296* (2013.01); *B65D 2543/00527* (2013.01); *B65D 2543/00537* (2013.01);
(Continued)

(58) Field of Classification Search
CPC ..... B65D 85/80; B65D 81/3255; B65D 81/3227; B65D 81/3222; B65D 81/3216; B65D 81/3211; B65D 51/2885; B65D 51/2871; B65D 51/2864; B65D 51/2857; B65D 25/08; B65D 25/087; B65D 45/20; A47G 2400/062; A61J 1/2093
See application file for complete search history.

(56) References Cited

U.S. PATENT DOCUMENTS 2,207,325 A * 7/1940 Maersch ..... B65D 81/3818 220/23.87
3,856,138 A * 12/1974 Maekawa ..... B65D 81/3222 206/221
(Continued)

FOREIGN PATENT DOCUMENTS

FR 2708870 A1 * 2/1995 ..... B01F 13/002

*Primary Examiner* — Mollie Impink
(74) *Attorney, Agent, or Firm* — Mark M. Friedman

(57) ABSTRACT

A container apparatus includes a first container and a second container for receipt by the first container. A temporary seal is formed in part by each of the first container and the second container. The temporary seal maintains the second container in the first container. The second container is movable between a first position, in which the temporary seal is engaged, and a second position, in which the temporary seal is disengaged. A lid forms a sealing engagement with the second container to define a lifting mechanism.

7 Claims, 10 Drawing Sheets

(51) Int. Cl.
*B65D 43/02* (2006.01)
*B65D 51/28* (2006.01)
*B65D 81/38* (2006.01)

(52) U.S. Cl.
CPC ..... *B65D 2543/00648* (2013.01); *B65D 2543/00694* (2013.01); *B65D 2543/00777* (2013.01); *B65D 2543/00805* (2013.01); *B65D 2543/00842* (2013.01)

(56) References Cited

U.S. PATENT DOCUMENTS

| | | | | |
|---|---|---|---|---|
| 4,509,641 | A * | 4/1985 | Scieri | B65D 83/682 206/219 |
| 4,905,825 | A | 3/1990 | Brader | |
| 6,364,152 | B1 * | 4/2002 | Poslinski | A47J 36/10 215/270 |
| 8,083,056 | B1 | 12/2011 | Wu | |
| 8,104,611 | B2 * | 1/2012 | Helou, Jr. | B65D 81/3222 206/219 |
| 8,360,262 | B2 | 1/2013 | Vovan | |
| 9,855,571 | B2 * | 1/2018 | Camilleri | B01F 15/00512 |
| 2002/0110623 | A1 | 8/2002 | Rebhor et al. | |
| 2003/0157224 | A1 | 8/2003 | Westerhof et al. | |
| 2004/0134222 | A1 * | 7/2004 | Holley, Jr. | B65D 25/08 62/457.4 |
| 2007/0138046 | A1 | 6/2007 | Vovan | |
| 2010/0003379 | A1 | 1/2010 | Zoss et al. | |
| 2012/0258213 | A1 | 10/2012 | Sharma | |
| 2013/0026124 | A1 * | 1/2013 | Wu | B65D 81/3222 215/6 |
| 2013/0146592 | A1 | 6/2013 | Kalaouze | |
| 2014/0238995 | A1 * | 8/2014 | Vargas | B65D 25/08 220/523 |
| 2016/0288981 | A1 * | 10/2016 | Festa | A47J 47/02 |

* cited by examiner

CONTAINER APPARATUS FOR STORING AND COMBINING MATERIALS

TECHNICAL FIELD

The present invention relates to containers.

BACKGROUND OF THE INVENTION

The storage and subsequent combining of wet and dry food items in separate respective containers attached to form a single packaging is known in the art. For example, the packaging of yogurt and granola in separate containers in a single packaging is commonly sold in grocery stores. However, such packaging arrangements require the consumer to open both containers and to shovel the contents of one container into the other container.

SUMMARY OF THE INVENTION

The present invention is a device and corresponding components for providing a material storage and combining functionality.

According to an embodiment of the teachings of the present invention there is provided, a container apparatus comprising: (a) a first container; (b) a second container for receipt by the first container; and (c) a temporary seal formed in part by each of the first container and the second container, the temporary seal for maintaining the second container in the first container, the second container movable between a first position, in which the temporary seal is engaged, and a second position, in which the temporary seal is disengaged.

Optionally, the temporary seal is a liquid seal.

Optionally, the first container includes a bottom surface member configured to maintain the second container in a fixed position.

Optionally, the first container includes a plug in the bottom surface member, and the second container includes an aperture in a bottom surface member, and the seal is defined by the plug and the aperture.

Optionally, the container apparatus comprises a lid for sealing at least the second container.

Optionally, the lid is configured to engage the second container to define a lifting mechanism.

Optionally, the second container includes at least one flange, and the engagement is defined in part by a portion of the lid being selectively attachable to the flange Optionally, the second container includes an outer sidewall member and a partition groove disposed on the outer sidewall member.

Optionally, the container apparatus comprises a partition configured to fit in the partition groove.

Optionally, the container apparatus is made of polycarbonate plastic.

Optionally, the second container comprises: an outer sidewall member and an inner sidewall member arranged to define an internal volume There is also provided according to an embodiment of the present invention, a container apparatus comprising: (a) a first container; (b) a second container for receipt by the first container; and (c) a lid configured to form a sealing engagement with the second container to define a lifting mechanism.

Optionally, the second container includes at least one flange, and the engagement is defined by a portion of the lid being selectively attachable to the flange.

Optionally, the container apparatus comprises: (a) a temporary seal formed in part by the first container and the second container, the temporary seal for maintaining the second container in the first container, the second container movable between a first position, in which the temporary seal is engaged, and a second position, in which the temporary seal is disengaged.

Optionally, the temporary seal is a liquid seal.

Optionally, the first container includes a bottom surface member configured to maintain the second container in a fixed position.

Optionally, the first container includes a plug in the bottom surface member, and the second container includes an aperture in a bottom surface member, and the seal is defined by the plug and the aperture.

Optionally, the container apparatus is made of polycarbonate plastic.

Optionally, the second container comprises: an outer sidewall member and an inner sidewall member arranged to define an internal volume.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
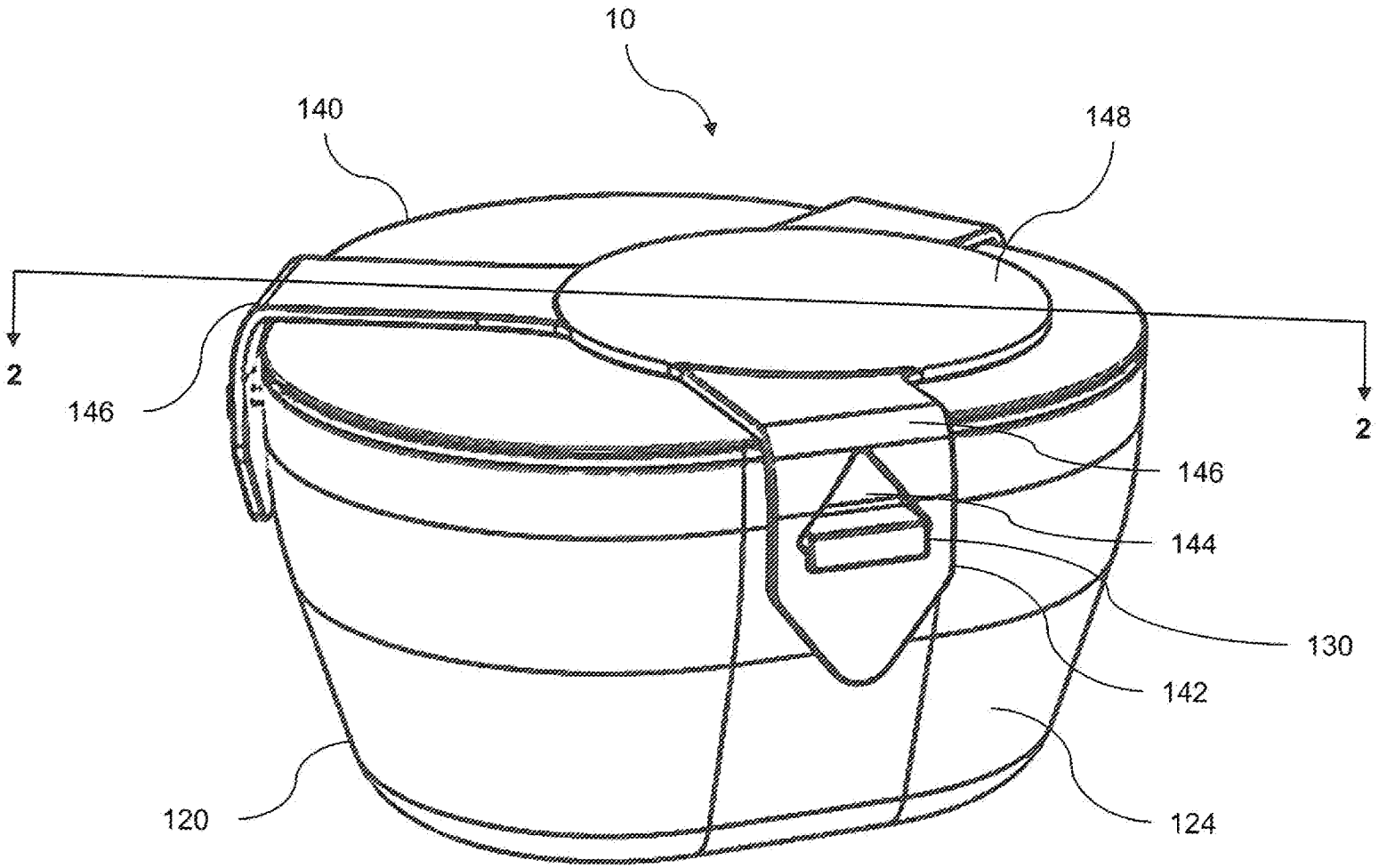
FIG. 1 is a perspective view of an assembled container apparatus according to an embodiment of the invention.

The present invention is a device and corresponding components for providing a material storage and combining functionality.

The principles and operation of a device and corresponding according to the present invention may be better understood with reference to the drawings and the accompanying description.

The present invention is applicable to the storage of many different types of materials, including but not limited to, paints, liquids, granular materials, food items, and beverages. The present invention is of particular value when applied to the storage of materials of different consistencies, where it is desirable to combine materials by pouring the contents of one container into another container. Although the examples provided in the description herein are for food and beverage items, the potential applications of the present invention should not be limited to the applications used for the purposes of illustrating the principles and operation of a device and corresponding components according to the present invention. Before explaining at least one embodiment of the invention in detail, it is to be understood that the invention is not necessarily limited in its application to the details of construction and the arrangement of the components set forth in the following description and/or illustrated in the drawings and/or the examples. The invention is capable of other embodiments or of being practiced or carried out in various ways. Initially, throughout this document, references are made to directions such as, for example, upper and lower, top and bottom, right, left, and the like. These directional references are exemplary only to illustrate the invention and embodiments thereof.

Figure 2:
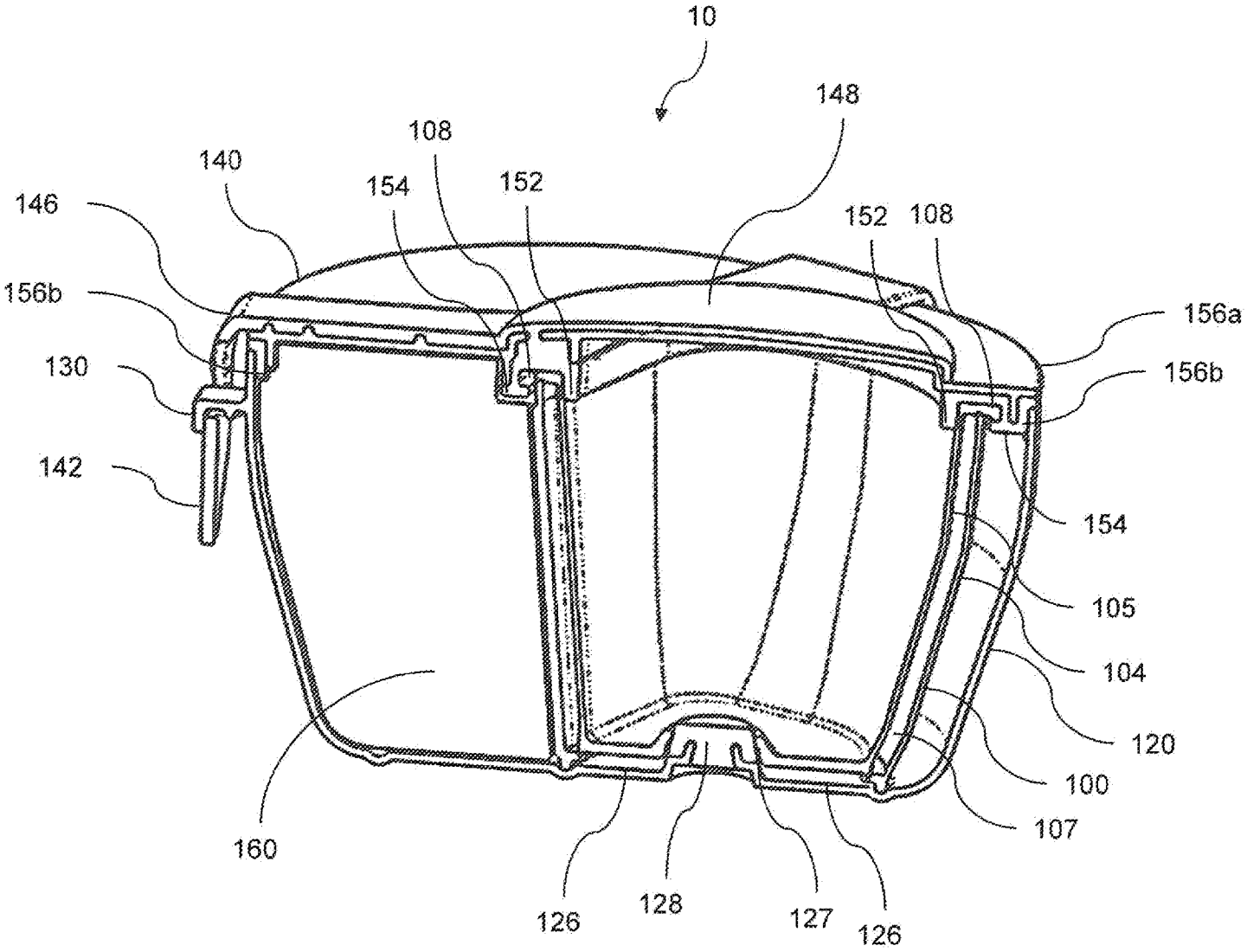
FIG. 2 is a side view partially in section of assembled container apparatus according to an embodiment of the invention.

Referring now to the drawings, FIGS. 1 and 2 show a container apparatus 10 in assembled form. Container apparatus 10 includes a first container 120 for storing a material, for example, designed to hold a solid food item, a second container 100 for storing a material, for example, designed to hold a liquid, and a lid 140 for covering containers 100 and 120. Container apparatus 10 maintains the integrity of the contents of first and second containers 100 and 120 as will be described in more detail below.

Figure 3A:
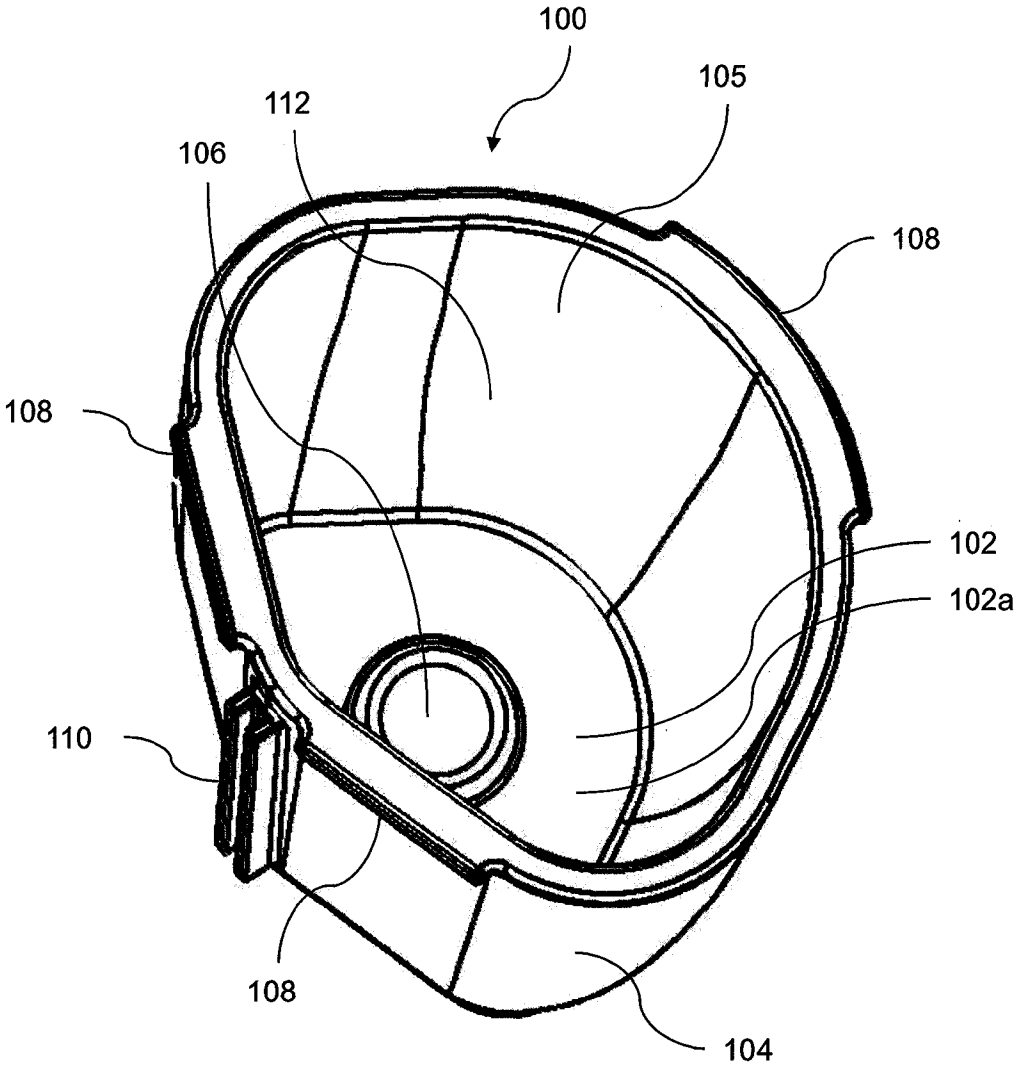
FIGS. 3A-3B are perspective views of a first container from a container apparatus according to an embodiment of the invention.
Figure 3B:
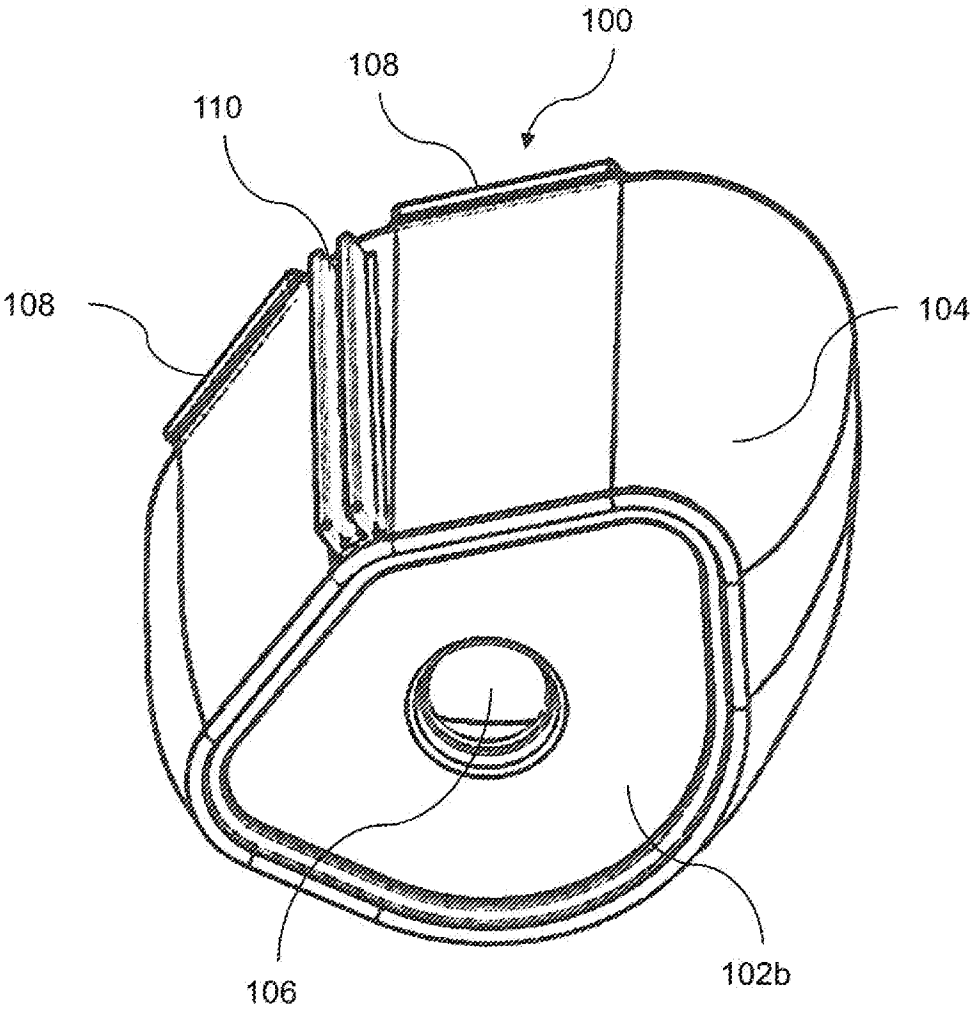

Second container 100 can be of various shapes, including, but not limited to, cup shaped, rectangular, and bowl shaped. It is preferable that second container 100 is cup shaped, and for naming convention purposes, is hereinafter referred to as cup 100. Cup 100 is primarily defined by a cup bottom surface member 102, a cup outer sidewall member 104, and a cup opening 112. Cup bottom surface 102 has an inner surface 102*a* and an outer surface 102*b*. The preferred structure of cup 100 is shown in FIGS. 3A-3B. As depicted in FIGS. 3A-3B, cup 100 has an aperture 106, preferably circular in shape, in cup bottom surface 102. Cup 100 is temporarily sealable by the engagement of aperture 106 with a component correspondingly configured to fit in aperture 106. Cup 100 is configured to fit inside of first container 120 and preferably has at least one flange 108 disposed about opening 112. Cup 100 is movable between a first position, in which cup 100 rests in first container 120, and a second position, in which cup 100 is removed from first container 120. Flange 108 helps to facilitate the movement of cup 100 between first and second positions and aides in securing lid 140 to cup 100 as will be described in subsequent sections of the description. In FIGS. 3A, 3B, 6 and 8, cup 100 is shown with three non-contiguous flanges 108 disposed about opening 112. It is noted that many other flange arrangements are possible, including a single contiguous flange 108 disposed about the opening 112.

Cup 100 preferably includes an inner sidewall member 105, thereby creating a double sidewall arrangement consisting of inner and outer sidewalls 105 and 104. The double sidewall arrangement defines an internal volume 107 in the space between inner and outer sidewalls 105 and 104. In such a configuration, internal volume 107 can be filled with a refrigerant substance which can be cooled in order to provide cooling insulation for the contents of cup 100. Examples of refrigerant substances include, but are not limited to, refrigerant gels and water. This is of particular value when cup 100 contains materials which are preferably stored at cold temperatures such as milk, yogurt, or other perishable materials. Internal volume 107 is preferably filled with the cooling substance during manufacturing of cup 100.

Figure 4:
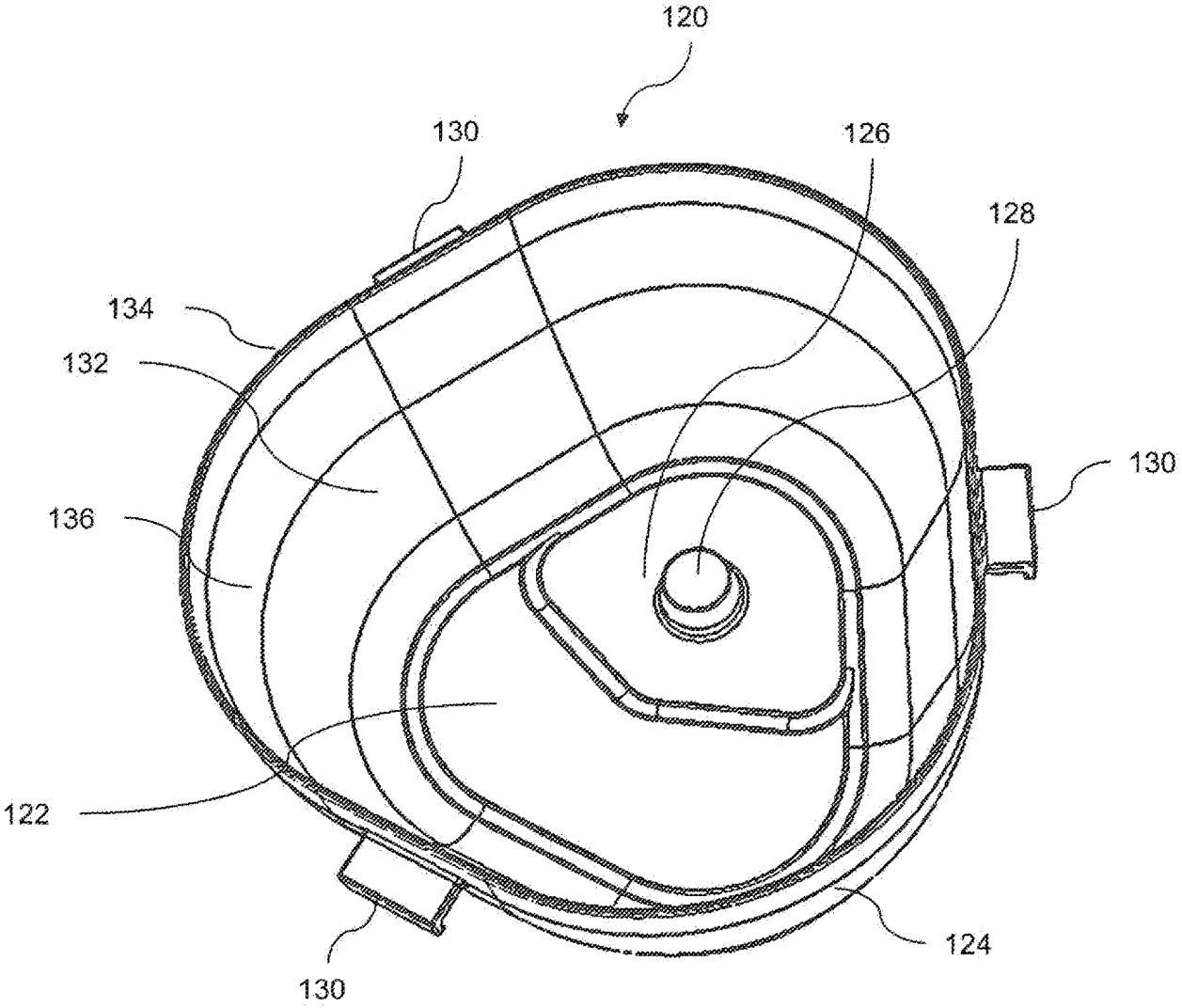
FIG. 4 is a perspective view of a second container from a container apparatus according to an embodiment of the invention.

First container 120 can be of various shapes, including, but not limited to, bowl shaped, rectangular, and cup shaped. It is preferable that first container 120 is bowl shaped, and for naming convention purposes, is hereinafter referred to as bowl 120. Bowl 120 is primarily defined by a bowl bottom surface 122, bowl sidewalls 124, and a bowl opening 132. Bowl 120 preferably has a contoured inner surface 136. The preferred structure of bowl 120 is shown in FIG. 4. As depicted in FIG. 4, preferably bowl 120 includes a bowl rim 134 disposed about bowl opening 132. Bowl 120 preferably includes a cup 100 receiving portion 126 correspondingly configured with respect to the shape of outer surface 102*b* of cup bottom surface 102. The configuration of receiving portion 126 enables cup 100 to be held in a fixed position in bowl 120 by positioning cup 100 in receiving portion 126. Receiving portion 126 and outer surface 102*b* define an interface 127 between cup 100 and bowl 120 for the formation of a sealing engagement of cup 100 as will now be described.

Bowl 120 includes a plug 128 positioned in bowl bottom surface 122 within receiving portion 126. Plug 128 is of a shape correspondingly configured to fit inside of aperture 106 of cup 100 such that when cup 100 is positioned in receiving portion 126 (i.e. in the first position), a seal is formed by the engagement of aperture 106 by plug 128. The engagement of aperture 106 by plug 128 contributes to maintaining cup 100 in bowl 120, and prevents the contents of cup 100 from escaping through aperture 106. Likewise, when cup 100 is removed from bowl 120 (i.e. in the second position), the seal formed by the engagement of plug 128 with aperture 106 is disengaged, allowing the contents in cup 100 to flow through aperture 106 and integrate with the contents of bowl 120. Because aperture 106 is preferably circular, it is preferred that plug 128 is cylindrical in shape. Bowl 120 preferably includes multiple fastening ears 130 disposed about bowl sidewalls 124 for facilitating the attachment of lid 140 to bowl 120. Bowl 120 preferably has at least three fastening ears 130. Each of fastening ears 130 is preferably connected to bowl 120 below bowl opening 132. The placement of cup 100 inside of bowl 120 with lid 140 covering as depicted in FIG. 1 also has the advantage of providing additional insulation to the contents of cup 100. The added insulation helps to maintain the temperature of the contents of cup 100. This is particularly beneficial when cup 100 contains cold or hot material, such as milk or hot water.

Figure 5A:
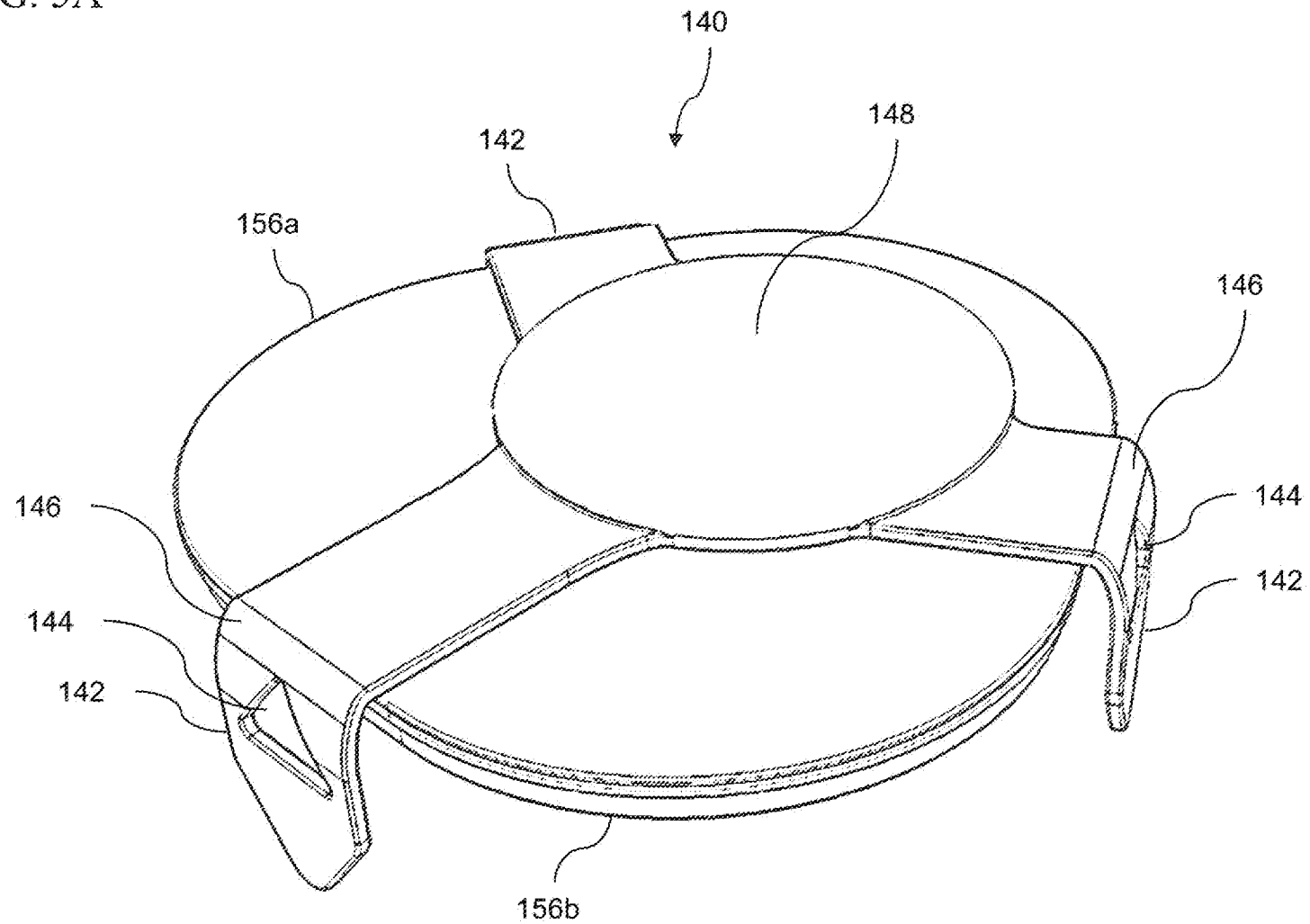
FIG. 5A is a perspective view of a lid from a container apparatus according to an embodiment of the invention.
Figure 5B:
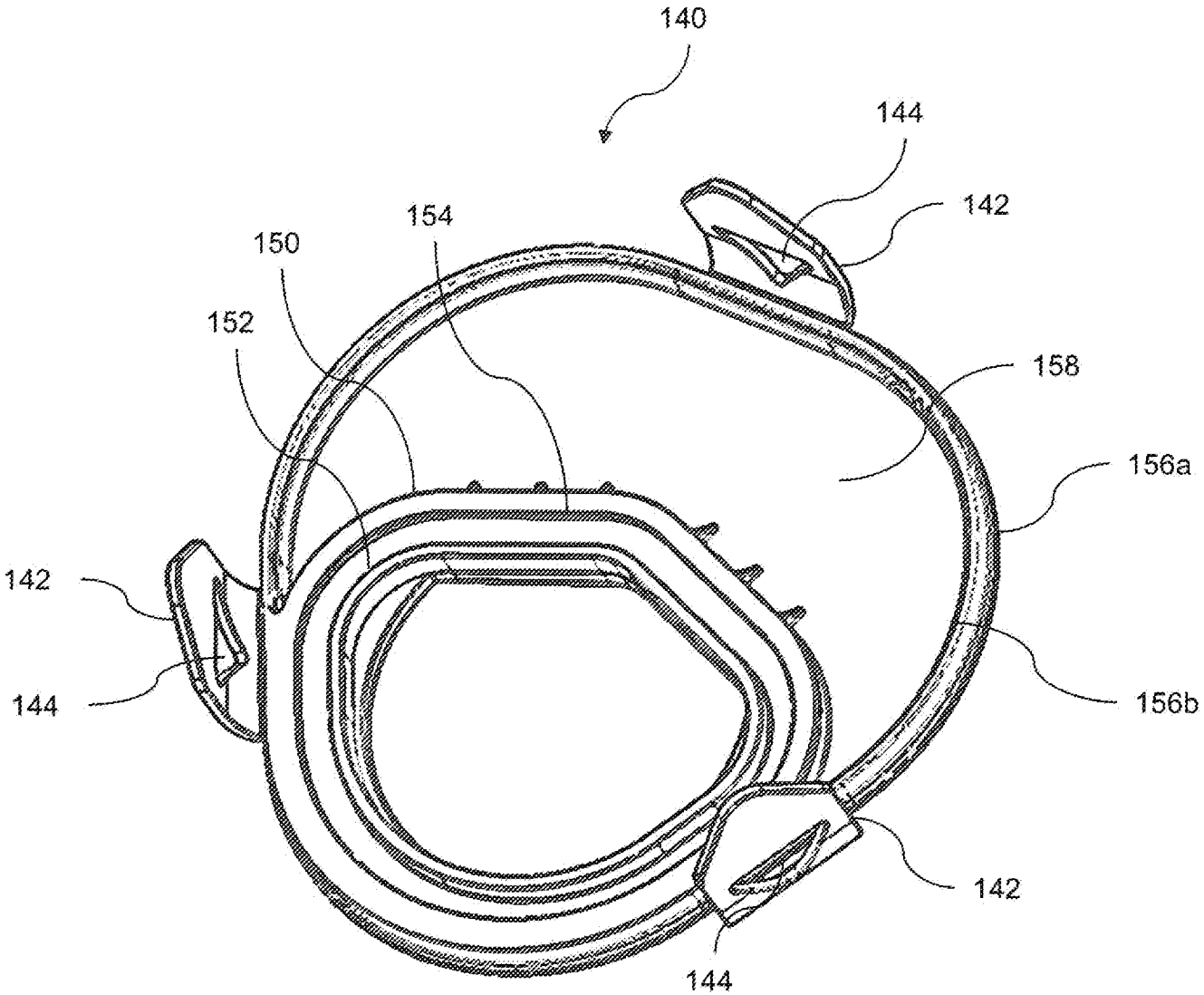
FIG. 5B is a perspective view of the underside of a lid from a container apparatus according to an embodiment of the invention.

Lid 140 is of approximately the same size and shape of bowl opening 132. The preferred structure of lid 140 is shown in FIGS. 5A-5B. As depicted in FIG. 5A, lid 140 preferably includes multiple fastening latches 142. Each fastening latch 142 preferably includes a latch aperture 144 and a flex joint 146. Latch aperture 144 is of size and shape such that fastening ear 130 fits through latch aperture 144 when fastening latch 142 is folded over fastening ear 130. Folding fastening latches 142 over fastenings ears 130 secures lid 140 to bowl 120. As depicted in FIG. 5A, latch aperture 144 is preferably triangular in shape. It is preferred that the number of fastening latches 142 is equal to the number of fastening ears 130.

According to certain embodiments, lid 140 includes a push top 148 and a flexible seal cap 150. As shown in FIG. 5B, it is preferred that seal cap 150 is located on the bottom side 158 of lid 140, opposite push top 148. Seal cap 150 is preferably of the size and shape of cup opening 112. Seal cap 150 preferably has a protruding inner portion 152 and an indented outer portion 154. Protruding inner portion 152 protrudes in a direction perpendicular to push top 148. As shown in FIG. 2, flanges 108 are configured to fit in the indentation of indented outer portion 154. When seal cap 150 is positioned over cup opening 112, pushing on push top 148 engages lid 140 with cup 100 by forcing protruding inner portion 152 to enter cup opening 112. Pushing on push top 148 also forces flanges 108 into the indentation of indented outer portion 154, such that indented outer portion 154 attaches to flanges 108. This creates a seal over cup opening 112, preventing the contents of cup 100 from escaping through cup opening 112 if cup 100 is shaken, rotated, and/or inverted. The engagement of indented outer portion 154 to flanges 108 defines a lifting mechanism. The lifting mechanism allows for the movement of cup 100 between first and second positions by lifting and lowering lid 140.

According to certain embodiments, lid 140 includes a lid rim 156*a* disposed about the perimeter of lid 140. Lid rim 156*a* is preferably of size and shape approximately equal to bowl rim 134. Preferably, lid 140 includes a protruding rim 156*b* disposed about the bottom side 158 of lid 140. Protruding rim 156*b* protrudes in the same direction as protruding inner portion 152. When lid 140 is positioned over bowl 120, pressing on lid rim 156*a* closes and seals lid 140 over bowl 120, such that protruding rim 156*b* enters bowl opening 132, and lid rim 156*a* and bowl rim 134 are at an abutment. Securing lid 140 to bowl 120 is accomplished by folding fastening latches 142 over fastening ears 130 as previously described.

Figure 6:
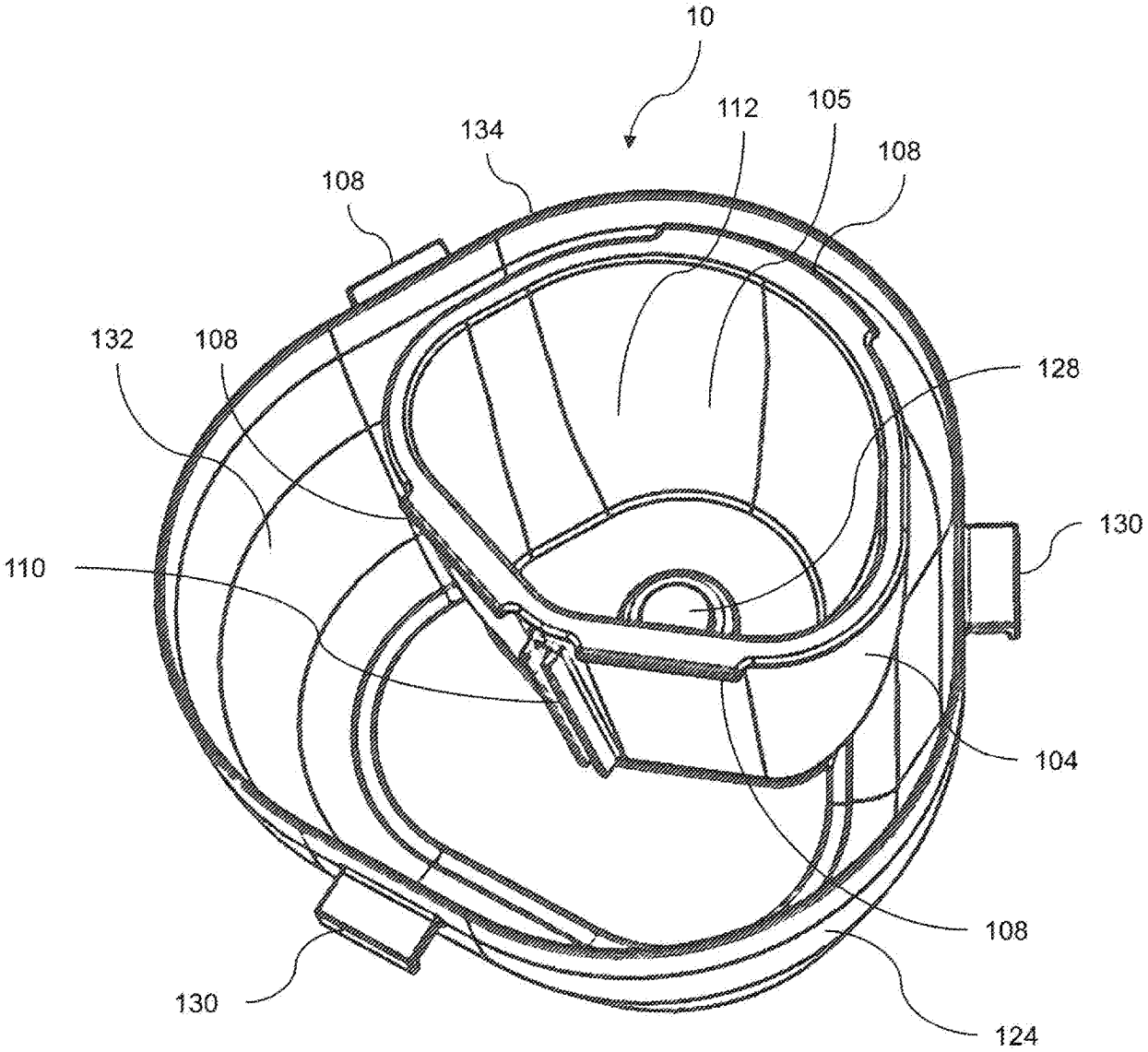
FIG. 6 is a perspective view of a partially assembled container apparatus according to an embodiment of the invention.

A specific example of use of container apparatus 10 is the packaging of dry cereal and milk. In operation, cup 100 is positioned in receiving portion 126 such that aperture 106 is sealed by plug 128. FIG. 6 shows a perspective view of cup 100 positioned inside of bowl 120. Milk is poured into cup 100 and dry cereal is poured into bowl 120. Lid 140 is placed over bowl 120 and cup 100 and is engaged to seal cup opening 112 and bowl opening 132 as previously described. As shown in FIG. 2, cup 100 is held in place between bowl 120 and lid 140. In this configuration, the separation of wet and dry ingredients in cup 100 and bowl 120 is maintained. The seals of openings 112 and 132 and aperture 106 ensure that the contents remain separate even if assembled container apparatus 10 is shaken, rotated and/or inverted. The integrity of the contents of container apparatus 10 is maintained until a user combines the contents. In this example, the seal formed by the engagement of aperture 106 by plug 128 is a liquid seal. In order to combine the contents of assembled container apparatus 10, fastening latches 142 are lifted from fastening ears 130. Seal cap 150 maintains the attachment of cup 100 to lid bottom side 158. As lid 140 is lifted, cup 100 is moved from its first position to its second position via the lifting mechanism previously described. As previously described, this movement removes plug 128 from aperture 106 permitting the milk to flow from cup 100 into bowl 120, thereby integrating the milk and cereal. The lid 140 with attached cup 100 can be set aside on a surface, such as a countertop or the like, with push top 148 facing towards the surface. This helps to ensure that any remaining contents of cup 100 are collected in seal cap 150 and do not spill out of aperture 106.

Figure 7:
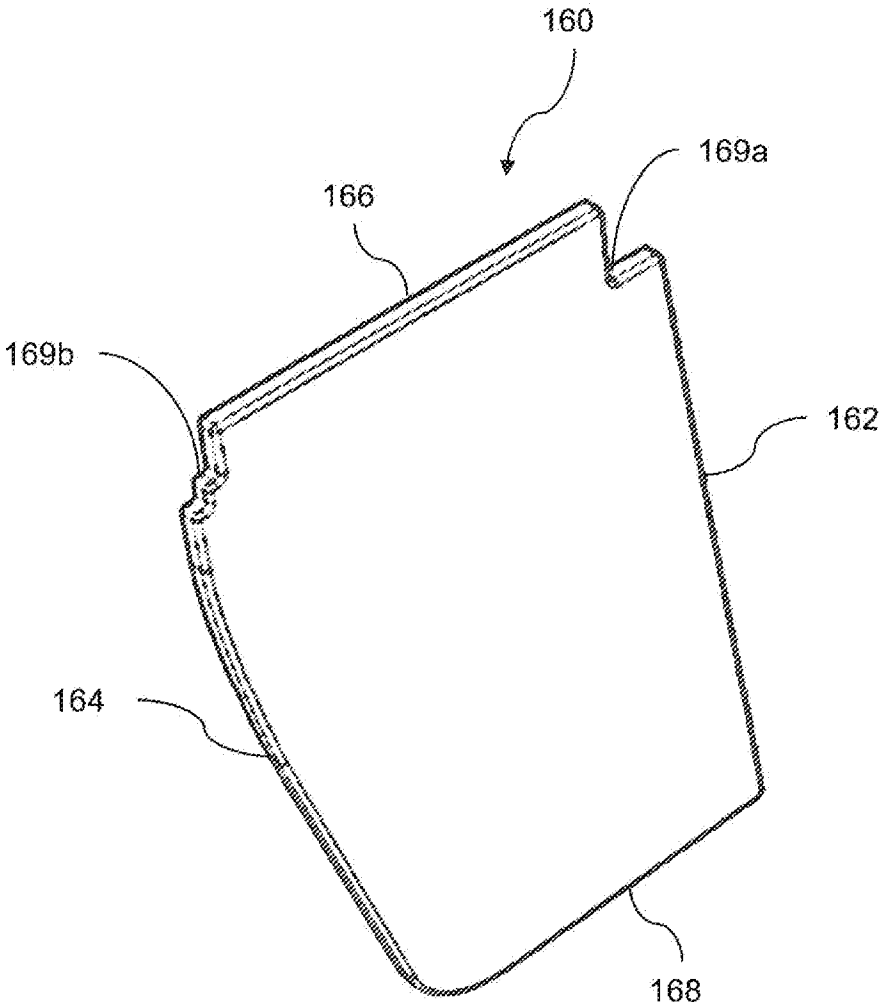
FIG. 7 is a perspective view of a partition from a container apparatus according to an embodiment of the invention.
Figure 8:
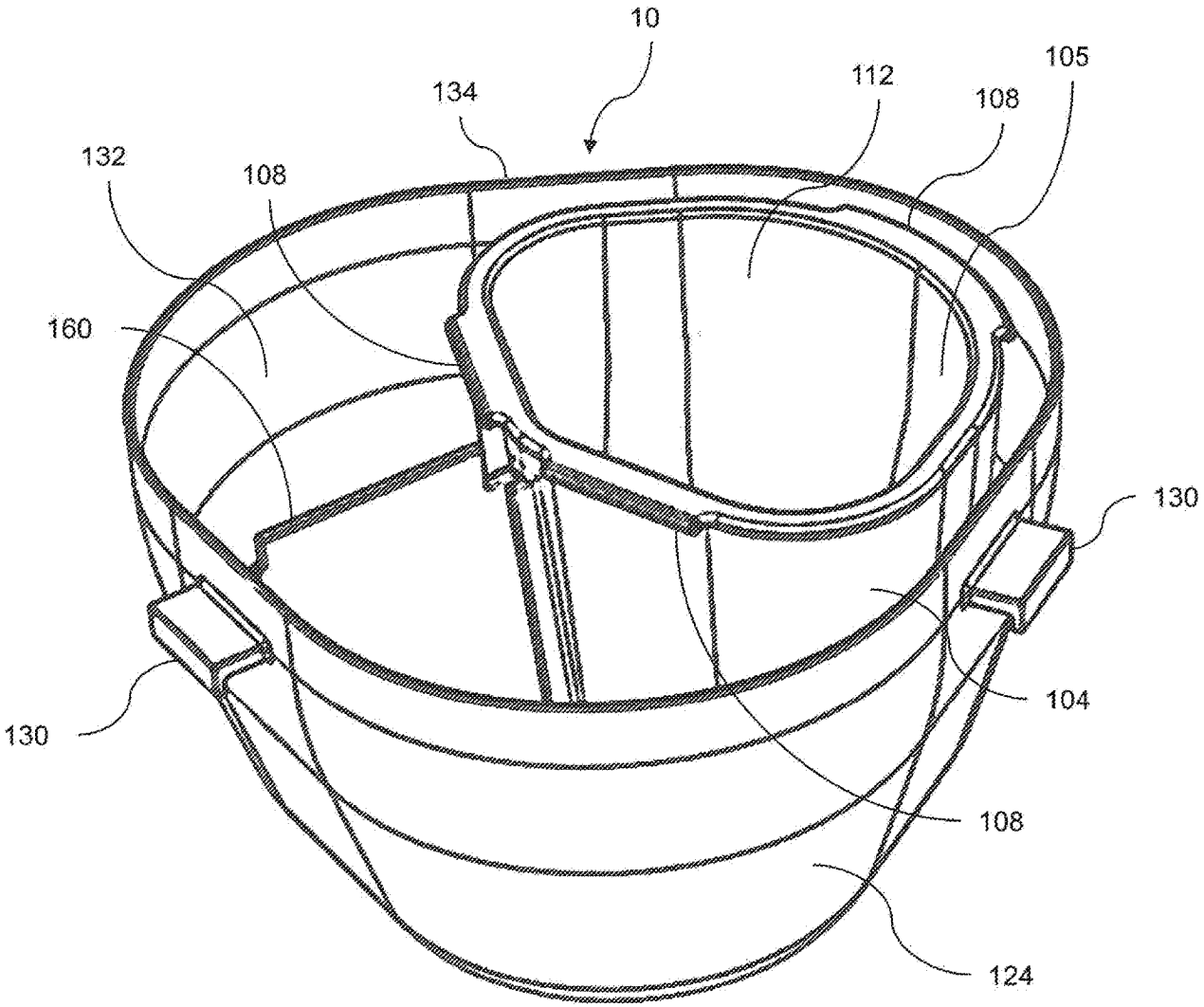
FIG. 8 is a perspective view of a partially assembled container apparatus according to an embodiment of the invention.

According to certain embodiments, cup 100 further includes a partition groove 110 attached to a portion of cup outer sidewall 104. Partition groove 110 preferably runs vertically along cup outer sidewall 104. It is preferred that partition groove 110 extends along at least 80% of the height of cup 100. In such an embodiment, container apparatus 10 preferably includes a partition 160 for fitting in partition groove 110. Preferably, partition 160 is generally rectangular in shape, with cutout corners 169*a* and 169*b*. The preferred structure of partition 160 is shown in FIG. 7. Partition 160 includes a right edge 162, a left edge 164 opposite of right edge 162, an upper edge 166 perpendicular to right and left edges 162 and 164, and a lower edge 168 opposite of upper edge 166. Right edge 162 of partition 160 is configured to slide into partition groove 110. It is preferred that right edge 162 is of width correspondingly configured to fit in partition groove 110 such that partition 160 is held securely in place. FIG. 8 shows a perspective view of cup 100 positioned inside of bowl 120 with partition 160 positioned in partition groove 110. As shown in FIG. 8, partition 160 serves to partition the space in bowl 120 into two interior spaces, a first space 170 and a second space 172. In such an embodiment, the volumes of first and second spaces 170 and 172 are approximately equal. It is preferred that edges 164, 166, and 168 are of appropriate shape and length such that when cup 100 is positioned in receiving portion 126 with lid 140 covering cup 100 and bowl 120, edges 164, 166, and 168 are at abutments with the corresponding bowl and lid surfaces. Specifically, left edge 164 is at an abutment with contoured inner surface 136, lower edge 168 is at an abutment with bowl bottom surface 122, and upper edge 166 is at an abutment with lid bottom side 158. When cup 100 is positioned in bowl 120 and lid 140 is secured to the cup 100 and bowl 120, indented outer portion 154 fills the void created by cutout 169*a*. Similarly, lid rim 156*a* and protruding rim 156*b* fill the void created by cutout 169*b*. The filled voids in combination with partition 160 facilitate the separation of first space 170 and second space 172.

A specific example of use of container apparatus 10 with partition 160 is the packaging of dry cereal, fruit, and milk. In operation, cup 100, bowl 120, and partition 160 are positioned as shown in FIG. 8. Milk is poured into cup 100. Dry cereal is poured into first space 170 of bowl 120, and fruit is placed in second space 172 of bowl 120. Lid 140 is placed over bowl 120 and cup 100 and is engaged to seal cup opening 112 and bowl opening 132 as previously described. Cup 100 is held securely in place between bowl 120 and lid 140. Cup opening 112 is sealed by seal cap 150 and aperture 106 is sealed by plug 128. The milk, dry cereal, and fruit remain separated in cup 100, first space 170 of bowl 120, and second space 172 of bowl 120 respectively. The combining of ingredients in assembled container apparatus 10 with partition 160 is as previously described. Partition 160 is lifted together with cup 100, permitting the fruit and the cereal to be combined in bowl 120.

Although the container apparatus 10 described thus far has pertained to a cup 100 with a single partition groove 110 for holding a partition 160, other embodiments are possible in which cup 100 has multiple partition grooves positioned around different portions of cup outer sidewall 104. In such an embodiment, a single partition 160 can be inserted into any one of the multiple partitions grooves in order to change the relative sizes of first space 170 and second space 172. Alternatively container apparatus 10 may include a plurality of partitions 160, and any or all of partition grooves may hold a partition 160 simultaneously in order to create more than two partitioned spaces in bowl 120.

Although the container apparatus 10 described thus far has pertained to a single cup 100 configured to rest in a bowl 120, other embodiments are possible in which various cups of different sizes are configured to rest in a single bowl 120. In such an embodiment, all such cups have identical bottom surfaces correspondingly configured to rest in receiving portion 126 of bowl 120.

The major elements of container apparatus 10 can be made from any suitable material, including, but not limited to, plastic materials, such as polycarbonate plastic or the like, metal, and glass. The major elements of container apparatus 10 may be manufactured from the same material, or from any combination of the materials provided above. For example, a container apparatus 10 may include a lid 140 and a partition 160 manufactured from a plastic material, and a cup 100 and a bowl 120 manufactured from glass.

Although the above examples describe the storage and subsequent combining of food stuffs, container apparatus 10 can be used for storing and subsequently combining any suitable materials, including, but not limited to, paints, oil based substances, granular materials such as sand or the like, and other compounds. The materials used for manufacturing the major elements of container apparatus 10 can correspond to different uses of container apparatus 10. One non-limiting example is a container apparatus 10 for storing and combining paints. In such an example, it may be preferable to manufacture cup 100, bowl 120 and lid 140 from a type of metal to which the paints do not adhere.

It will be appreciated that the above descriptions are intended only to serve as examples, and that many other embodiments are possible within the scope of the present invention as defined in the appended claims.

What is claimed is:

1. A container apparatus comprising:

(a) a first container including: sidewalls, at least two fastening ears disposed about said sidewalls, a bottom surface member, and a plug in said bottom surface member;

(b) a second container for receipt by said first container, said second container including: a bottom surface member having an aperture, a wall extending about a periphery of said aperture and extending into said second container from said bottom surface member of said second container, and at least one flange disposed about an opening of said second container;

(c) a lid for covering and uncovering said first and second containers, said lid including:

i) a push top positioned on a top side of said lid, ii) a flexible seal cap formed on a bottom side of said lid opposite said push top, said flexible seal cap conforming in size and shape to the opening of said second container and including an indented portion configured to attach to said at least one flange in response to pressure applied to said push top, so as to directly attach said lid to said second container, and iii) at least two fastening latches configured to: engage with said fastening ears so as to securely attach said lid to said first container, and disengage from said fastening ears so as to detach said lid from said first container; and (d) a temporary seal formed in part by each of said plug and said aperture, said temporary seal for maintaining said second container in said first container, said second container movable between a first position, in which said temporary seal is engaged, and a second position, in which said temporary seal is disengaged, wherein said fastening latches are disengaged from said fastening ears and then said second container is lifted so as to move from said first position to said second position, wherein said lid is configured to remain directly attached to said second container via attachment of said indented portion to said at least one flange during movement from said first position to said second position.

2. The container apparatus of claim 1, wherein said temporary seal is a liquid-tight seal.

3. The container apparatus of claim 1, wherein said first container includes a bottom surface member configured to maintain said second container in a fixed position.

4. The container apparatus of claim 1, wherein said second container further includes an outer sidewall member and a partition groove disposed on said outer sidewall member.

5. The container apparatus of claim 4, further comprising a partition configured to fit in said partition groove.

6. The container apparatus of claim 1, wherein said container apparatus is made of polycarbonate plastic.

7. The container apparatus of claim 1, wherein said second container comprises: an outer sidewall member and an inner sidewall member arranged to define an internal volume.

* * * * *